US005394579A

United States Patent [19]

Walters

[11] Patent Number: 5,394,579

[45] Date of Patent: Mar. 7, 1995

[54] METHOD AND DEVICE FOR SECURING A FLEXIBLE COVERING

[76] Inventor: Norman V. Walters, 9221 Sequoia, Houston, Tex. 77041

[21] Appl. No.: 11,819

[22] Filed: Feb. 1, 1993

[51] Int. Cl.[6] ..... A47C 21/02

[52] U.S. Cl. ..... 5/504.1; 5/498; 24/115 G; 24/72.5

[58] Field of Search ..... 5/496, 498, 504.1, 658; 24/115 G, 115 H, 72.5, 298

[56] References Cited

U.S. PATENT DOCUMENTS

| | | | |
|---|---|---|---|
| D. 288,162 | 2/1987 | Hutton et al. . | |
| 371,035 | 10/1887 | Crandall | 5/504.1 |
| 806,521 | 12/1905 | Childs | 5/498 |
| 816,710 | 4/1906 | Buley . | |
| 1,401,340 | 12/1921 | Lindsay | 24/72.5 |
| 2,840,873 | 7/1958 | Meier | 24/115 H |
| 3,080,867 | 3/1963 | Eichinger | 24/115 G |
| 3,604,069 | 9/1971 | Jensen | 24/115 G |
| 4,660,240 | 4/1987 | Hutton et al. . | |
| 4,782,543 | 11/1988 | Hutton et al. . | |
| 5,092,009 | 3/1992 | Griffith | 5/498 |
| 5,168,605 | 12/1992 | Bartlett | 24/459 |

FOREIGN PATENT DOCUMENTS

| | | | |
|---|---|---|---|
| 625439 | 4/1927 | France | 5/498 |
| 19 03 016 | 1/1969 | Germany | 24/115 H |

*Primary Examiner*—Michael J. Milano

*Attorney, Agent, or Firm*—Bush, Moseley, Riddle & Jackson

[57] ABSTRACT

A device (20) for releasably securing a flexible covering such as a sheet (18) on a water-filled mattress (16) within a supporting frame (12). The releasable device (20) includes a cord gripping subassembly (22) for gripping a non-elastic cord (74) between a pair of inner and outer bodies (26, 28) under a predetermined gripping force as determined by a spring (56) urging inner body (28) against cord lengths (80, 81) of the cord (74). A loop (82) is positioned over a retainer (78) beneath the sheet (18) and drawn tight by manual pulling of a cord length (81). Then the cord (74) is anchored to bracket (24) by pulling the free end (79) of the cord (74). A cord gripping subassembly (22A) on bracket (24) similar to cord gripping subassembly (22) grips this cord (74) on bracket (24) for tightening of the cord (74) extending from cord gripping subassembly (22) and retainer (78).

14 Claims, 2 Drawing Sheets

METHOD AND DEVICE FOR SECURING A FLEXIBLE COVERING

FIELD OF THE INVENTION

This invention relates to a method and device for securing a flexible covering over a member or material, and more particularly to such a device and method for securing or fastening a removable flexible covering to a fixed member.

BACKGROUND OF THE INVENTION

Removable flexible coverings are positioned over various members or materials, such as a tarpaulin, sheet, blanket, or the like and it is desired to secure or fasten the covering in a desired position over the member to be covered. The flexible coverings are normally of a generally rectangular shape defining four corners and the present invention is particularly adapted for releasably fastening the corners of such a covering.

One example of such a covering is a sheet on a waterbed. Waterbeds comprising water-filled mattresses are normally supported on a box-like bed frame which includes wooden frame members fastened together at their corners and surrounding the waterbed. It is difficult to retain the sheets on the waterbed in a neat and snug manner on the top of the water filled mattress. While the bed may be made up neatly, the sheets during use begin to become untucked from around the edges of the waterbed mattress. While very large sheets have been utilized heretofore to be tucked under the mattress by providing diagonal straps on the corners of the waterbed sheets, the sheets still become loose from the bed.

Heretofore, various fasteners or securing devices have been utilized for fastening the corners of a sheet over a bed, but such fasteners or devices have not performed in an entirely satisfactory manner. If some "give" is not provided for the member holding the fastener or retainer on the sheet so that the sheet can move, a destructive tearing force may be applied to the sheet or sheeting material. Many prior art devices utilize elastic members for holding a retainer member in place. Elastic materials lose their elasticity over a period of time if a continuous strain or stretch is applied.

For example, U.S. Pat. No. 4,660,240 dated Apr. 28, 1987 and U.S. Pat. No. 4,782,543 dated Nov. 8, 1988 show a device for attaching bed sheets to a waterbed which utilizes a separate unattached button or retainer engaged with a fastener member for applying a sliding force against the sheet wrapped over the button. If any defects occur in the button or sliding fastener, damage to the sheet could result. Additionally, an elastic member is provided to hold the separate button within the fastener. Also, a non-uniform tensional force is applied against the fastener and sheet unless the button is placed exactly in the same location and the sheet is stretched the same amount each time. In usage, the elastic material will increase in length requiring the user to place the button in a different location, but with continued use, the increased length stretch material will apply less and less pull as it permanently stretches out of shape with time. Further, there is a limit to the distance or length that the stretch material can be stretched, and upon reaching this limit, a destructive tearing force may be applied against the sheet by the button.

SUMMARY OF THE INVENTION

The present invention is directed to a device and method for removably securing or fastening generally rectangular coverings over desired members or materials. The invention utilizes a non-elastic cord having one end attached to a retainer and the other end free to form a loop for fitting over the retainer to secure the covering beneath the retainer. No elastic material or elastic members are utilized for exerting a tension load against the cord or sheet.

This invention permits the use of fasteners on the corners of a covering which apply substantially the same tensional load or pulling action against all of the corners of the covering so that unequal forces are not applied from different corners of the covering. Thus, tearing or wearing of the covering at the fastener is minimized. The generally uniform tensional force is applied against the fasteners regardless of the exact positioning of the fasteners on the corners of the covering. Thus, it is not necessary to position the fasteners at an exact location on the corner of the covering in order to provide a substantially uniform tensional force.

My invention utilizes a fixed bracket secured to a fixed frame member and a cord gripping subassembly to receive the cord in a gripping relation. The cord gripping subassembly includes an outer member and an inner member having aligned openings therein to receive lengths of the cord therethrough which form a loop for fitting over the retainer positioned beneath the covering and for securement beneath the retainer for securement of the covering. The inner body or member is movable relative to the outer member or body in a transverse direction relative to the aligned openings for gripping the lengths of a cord between the bodies, and resilient means urge the inner body relative to the outer body for gripping the cord lengths under a predetermined gripping force. When the tensional force in the cord exceeds a predetermined maximum force, the resilient means will automatically release the inner body to permit release of the cord lengths forming the loop, and upon the tensional force reaching a predetermined minimum, the resilient means will again apply a gripping action to the cord lengths thereby permitting a generally uniform force to be applied by each of the fasteners. The free end of the cord extends about an anchor on the fixed bracket and the free end may be manually gripped and pulled for tightening and securing the cord from the subassembly.

The method includes positioning of the retainer or ball beneath the covering and then placing a loop of the cord which is carried by the cord gripping subassembly over the covering and retainer beneath the covering. The cord from the cord gripping subassembly is then pulled manually to draw the subassembly tightly against the retainer. Then the free end of the cord which fits over an anchor member on the bracket is pulled thereby to tighten the cord between the subassembly and the bracket. In the event some slippage occurs in the cord between the subassembly and the bracket after use of the covering, the cord may be tightened by pulling the free end of the cord at the bracket.

It is an object of this invention to provide a method and device for detachably securing or fastening a generally rectangular covering over a member or material in which a substantially uniform tensioning force is applied by fasteners or retainers secured to the corners of the covering for releasably securing the covering.

It is a further object of this invention to provide such a method and device utilizing a non-elastic cord for detachably securing fasteners on the covering.

A further object of this invention is to provide such a method and device in which upon loosening of a fastener attached to a corner of the covering, the tensioning force securing the fastener may be easily reapplied by manual pulling on the free end of the cord thereby to maintain the desired tensioning force against the fastener.

It is another object of this invention to provide such a method and fastener in which the fasteners may be positioned at any desired location on the covering with a substantially equal tensioning force applied against the fasteners regardless of the specific location.

Other objects, features and advantages of this invention will become more apparent after referring to the following specification and drawings.

DESCRIPTION OF THE INVENTION

Figure 1:
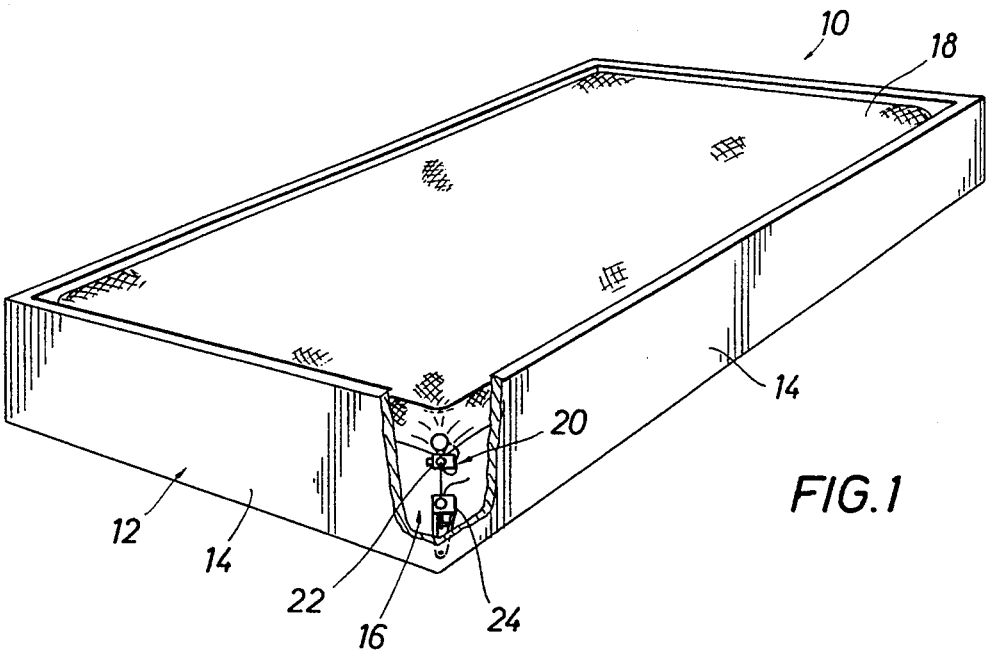
FIG. 1 is a perspective of one embodiment of the present invention in which the invention is illustrated for securing the corner of a sheet of a waterbed within an outer frame.

A preferred embodiment of this invention is illustrated in the drawings utilized with a bed shown generally at 10 having an outer supporting frame 12 of a generally rectangular shape comprising frame members 14 connected to each other. A water-filled mattress generally indicated at 16 is supported within frame 12 and a covering or bed sheet 18 is positioned over the water-filled mattress 16. As well known, it is difficult to maintain sheets on a waterbed in a neat and snug manner. Although the bed may be made up neatly, the sheet begins to become untucked from around the edges of the waterbed mattress 16 during use. Thus, it is desirable to provide a device to initially retain sheet 18 in a neat and snug manner and to maintain sheet 18 in a neat and snug manner on mattress 16 even after prolonged use.

The securing or attachment device comprising the present invention is illustrated generally at 20 and is adapted to be releasably attached to each of the four corners of the rectangular covering or sheet 18. Attachment device 20 includes a cord gripping subassembly shown generally at 22 and a bracket generally indicated at 24 forming an anchor for cord gripping subassembly 22.

Figure 5:
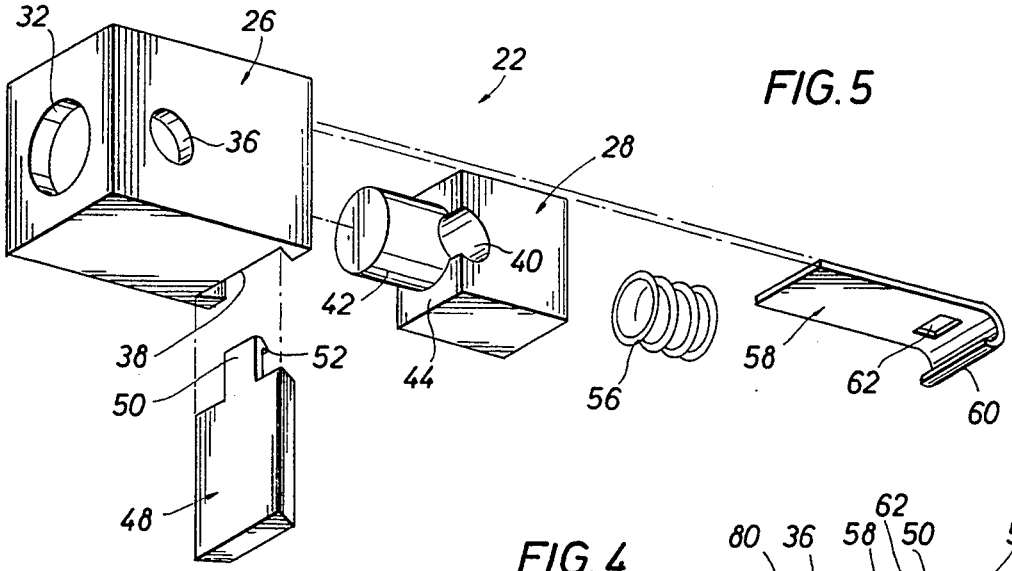
FIG. 5 is an exploded view of the cord gripping subassembly shown in FIGS. 2–4.
Figure 4:
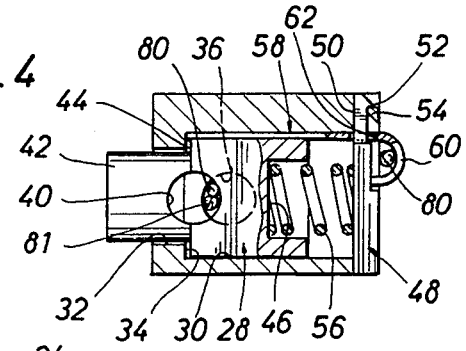
FIG. 4 is a longitudinal section of the cord gripping subassembly shown in FIGS. 2 and 3 showing the subassembly in cord gripping position.

Cord gripping subassembly 22 is illustrated in FIGS. 4–5 and comprises an outer body 26 having a central bore 30 defining a chamber or pocket therein for an inner body 28. Bore 30 has a reduced diameter bore portion 32 adjacent an end thereof defining an annular shoulder 34. Aligned openings 36 are provided in opposed walls of outer body 26 and a dovetailed groove 38 is provided on an outer end thereof. Inner body 28 is of a solid material having a lateral opening 40 therethrough adapted for alignment with openings 36 in outer body 26. An outer reduced diameter portion 42 forms a manually depressible button and defines a shoulder 44 adapted to abut against shoulder 34 of outer body 26. A recess 46 is formed in the inner end of body 28.

A lower closure member 48 is adapted to fit within dovetailed groove 38 and has a latch or catch 50 extending from an end thereof. Catch or latch 50 is resilient to permit flexure thereof and a detent 52 on its outer end is adapted to ride over and engage a cooperating detent 54 on body 26 as shown particularly in FIG. 4. A coil spring 56 is received within recess 46 and biased against closure member 48 for continuously urging inner body 28 and depressible button 42 outwardly. A cord guide is shown generally at 58 and has an arcuate guide portion 60 on one end thereof. An opening 62 in guide 58 is adapted to receive catch 50 to hold guide portion 60 against closure member 48.

Figure 2:
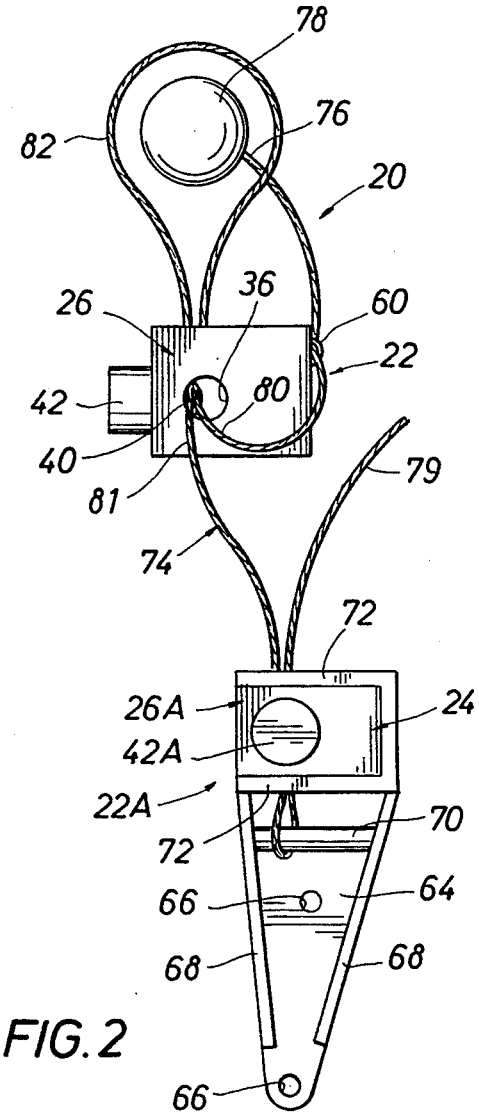
FIG. 2 is a perspective of the sheet securing device of FIG. 1 removed from the bed frame and showing a cord gripping subassembly receiving a pair of cord lengths forming a loop over a retainer and a bracket for releasably securing the free end of the cord.
Figure 3:
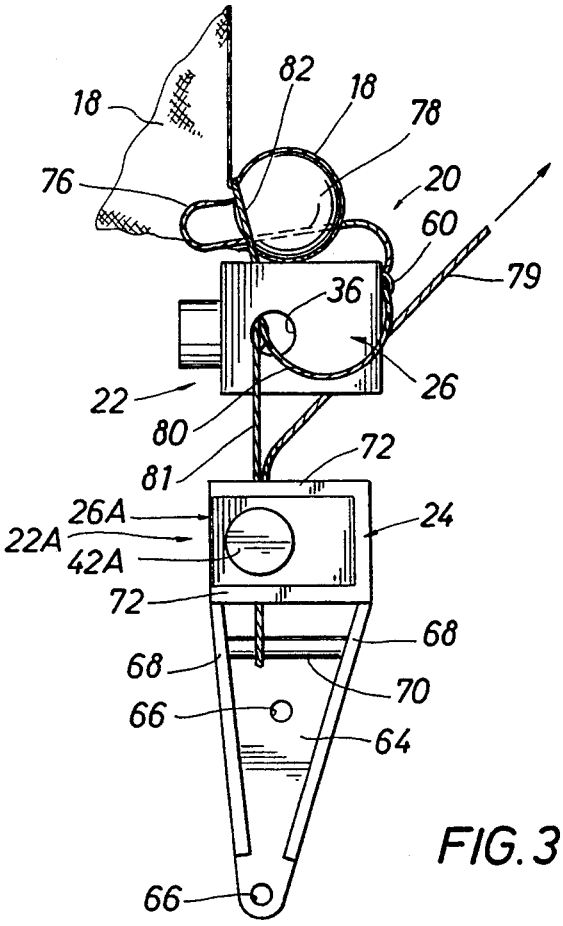
FIG. 3 is a perspective generally similar to FIG. 2 but showing the cord loop being positioned over the sheet and retainer beneath the sheet prior to tightening of the loop about the retainer.
Figure 6:
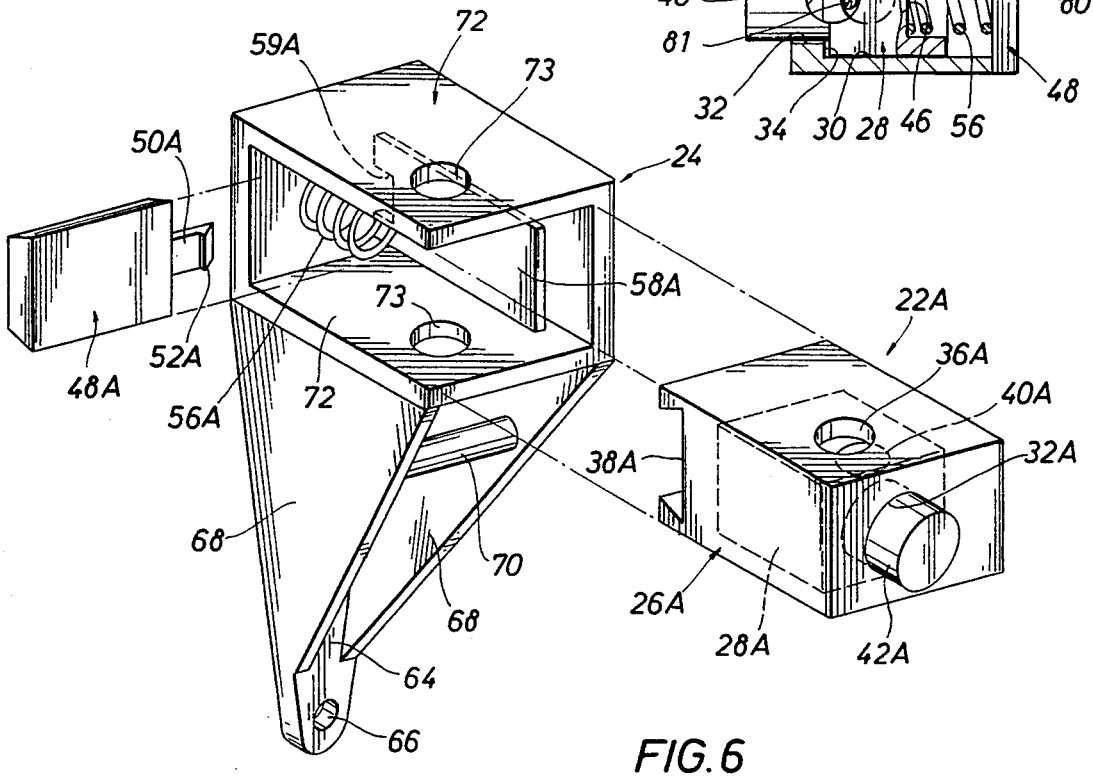
FIG. 6 is an exploded view of the bracket shown in FIG. 1 secured to the supporting frame.

Referring now particularly to FIGS. 2, 3, and 6, bracket 24 is shown having a lower generally vertical leg 64 with openings 66 therein adapted to receive a fastener, such as a screw or the like for securing bracket 24 to a frame member 14 of bed frame 12 adjacent to a corner of sheet 18. A pair of spaced parallel side flanges 68 have an anchor rod 70 secured therebetween. A pair of upper flanges 72 form a pocket therebetween and a guide 58A is secured between spaced flanges 72 within the pocket. A cord gripping subassembly 22A is positioned within the pocket formed between upper flanges 72. Outer body 26A of subassembly 22A has aligned openings 36A in opposed walls thereof and a dovetailed groove 38A. Inner body 28A has a manually depressible button 42A extending from opening 32A. Closure 58A fits within dovetailed groove 38A and detent 52A on resilient catch 50A engages guide 58A at slot 59A thereof as shown in FIG. 6. Guide 58A fits between inner body 28A and outer body 26A. Aligned openings 73 are provided in flanges 72 for alignment with openings 36A in outer body 26A and opening 40A in inner body 28A.

As shown in FIGS. 2 and 3, a non-elastic cord is shown generally at 74 and has one end or end portion 76 secured to a retainer or ball 78. Cord 74 may be formed, for example, of nylon. A free end or end portion of cord 74 is shown at 79. Cord 74 extends from retainer or ball 78 through guide 60 and cord lengths 80, 81 form a loop 82 and extend through aligned openings 36 and 40 in bodies 26, 28. As shown further in FIGS. 4–6, spring 56 urges inner body 28 toward shoulder 34 of outer body 26 and cord lengths 80, 81 are gripped between the peripheral surface defining opening 40 and the peripheral surfaces defining openings 36. Thus, a gripping force against cord lengths 80, 81 is provided by spring 56 and the amount of the gripping force is determined by the strength of spring 56.

In operation for initially fastening or securing a corner of sheet 18 as shown particularly in FIG. 3, ball 78 is positioned beneath sheet 18 and loop 82 is positioned over ball 78 and sheet 18 with cord lengths 80 and 81 extending through openings 36 and 40. Then, with button 42 manually depressed, length 81 of cord 74 is gripped and pulled manually to tighten loop 82 about ball 78 and to draw subassembly 22 against ball 78 as shown in FIG. 1. Upon the drawing of loop 82 tightly about ball 78, button 42 is released so that cord lengths 80 and 81 are gripped between the surfaces forming openings 36 and 40 under the force of spring 56.

For anchoring or securing cord gripping subassembly 22 to bracket 24 after securing of loop 82 about ball 78, the free end 79 of cord 74 with button 42A normally depressed is passed downwardly through openings 73, 36A and 40A about anchor rod 70 and then passed upwardly again through openings 73, 36A and 40A. Pulling on free end 79 draws cord gripping subassembly 22 tightly toward bracket 24. Then, depressible button 42A is released so that the cord lengths passing through cord gripping subassembly 22A are gripped between the peripheral surfaces defining openings 36A and 40A.

During use of sheet 18 and water-filled mattress 16, cord 74 may become loosened by tensional forces exerted by sheet 18 against ball 78. When the tensional force overcomes the gripping force exerted by springs 56 and 56A of cord gripping subassemblies 22 and 22A, then the cord will release until the tensional force is reduced to the spring force. Then, the gripping force applied by cord gripping subassembly 22 or 22A will again hold cord 74. Thus, no tearing of the covering or sheet 18 should result as the force exerted by spring 56 is predetermined and of an amount less than that resulting in tearing of sheet 18. In the event loosening of cord 74 occurs, cord 74 may be tightened at cord gripping subassembly 22A by pulling from free end 79 of cord 74. Retainer or ball 78 can be located at any desired corner position of sheet 18 and if four attachment devices are utilized, the attachment devices do not have to be positioned at exactly the same location on the corners of the sheet as substantially equal tensional forces may be applied against the sheet at the four corners without having any precise positioning of the devices. By providing a non-elastic cord, the cord does not stretch and retains its strength for an indefinite period of time if formed of a material such as nylon.

While the attachment device has been shown in the drawings as utilized for securing a sheet or bed covering over a water-filled mattress, it is to be understood that the present invention may be utilized for the securement of flexible coverings over various members or materials, such as a tarpaulin positioned over a container such as a truck body, for example. Also, the bed covering may be secured to an adjustable supporting frame, such as a hospital bed. Likewise, a tent or similar structure could have its ends or corners releasably secured by the present invention.

Since certain changes or modifications may be made in the disclosed embodiment without departing from the inventive concepts involved, it is the aim of the appended claims to cover all such changes and modifications falling within the true spirit and scope of the present invention.

What is claimed is:

1. A device for releasably securing a flexible covering to a relatively fixed outer supporting structure; said device comprising:

fixed anchor means secured to said structure;

a manually actuated cord adapted to be pulled by a user of said device;

a retaining member having an outer enlarged end for fitting beneath the flexible covering with said cord adapted to fit over the covering about said outer end for securing the covering on said retaining member;

a cord gripping subassembly for receiving said cord from said retaining member in a gripping relation; said cord gripping subassembly including force applying means for applying a predetermined gripping force against said cord upon release of said cord after a manual pulling of said cord tightly about said retaining member, said force applying means releasing said cord upon a predetermined high tensional force exerted against said cord from said retainer; and means releasably connecting said cord gripping subassembly to said fixed anchor means.

2. A device as set forth in claim 1 wherein said cord has one end secured to said retaining member and forms a loop extending from said cord gripping assembly for fitting over said covering about said outer end, said loop having at least one end portion thereof passing through said cord gripping subassembly with said force applying means contacting and applying a predetermined gripping force against said end portion.

3. A device as set forth in claim 2 wherein said cord gripping assembly includes inner and outer bodies having aligned openings therein for receiving lengths of said cord defining said loop, said inner body being movable relative to said outer body for gripping said end portions of said cord between peripheral surfaces defining said aligned openings of said bodies.

4. A device as set forth in claim 3 wherein resilient means are provided for urging said inner body relative to said outer body for gripping said cord under a predetermined gripping force.

5. A device as set forth in claim 4 wherein said inner body is manually depressible against said resilient means for manual release of said cord from said gripping action upon depression of said inner body.

6. A device as set forth in claim 1 wherein said anchor means secured to said frame has cord gripping means thereon and said cord extends from said cord gripping subassembly to said cord gripping means, said cord gripping means including force applying means for applying a predetermined gripping force against said cord with said cord having a free end thereof for gripping and pulling said cord against the force exerted by said force applying means whereby upon release of said free end after tightening said cord said force applying means grips said cord to retain said cord and cord gripping subassembly in a tightened relation.

7. A bed sheet attachment device for holding a generally rectangular bed sheet in place over a waterbed including a fluid-filled mattress supported on a bed frame having upstanding frame members surrounding at least a portion of the mattress; said attachment comprising:

a manually actuated cord adapted to be pulled by a user of said device;

a retaining member secured to an end of said cord of fitting beneath the bed sheet generally at the corner thereof;

a cord gripping subassembly for receiving the cord from said retaining member in a gripping relation, said cord gripping subassembly receiving the cord and including force applying means for applying a predetermined gripping force against said cord, said force applying means releasing said cord upon a predetermined high tensional force exerted against said cord from said retaining member;

said cord between said retaining member and said cord gripping subassembly being looped about said retaining member and said bed sheet over said retaining member thereby to secure said bed sheet to said retaining member; and means to anchor said cord gripping subassembly to a frame member of said bed frame comprising a bracket secured to said frame member, said cord gripping subassembly being releasably connected to said bracket.

8. A bed sheet attachment as set forth in claim 7 wherein a free end of said cord extends from said subassembly about an anchor on said bracket whereby upon manual gripping of said free end and pulling thereof said subassembly is pulled tight toward said bracket.

9. A bed sheet attachment as set forth in claim 8 whereon means on said bracket releasably grip said cord upon pulling of said cord tight and releases said cord upon a predetermined high tensional force exerted against the cord by said retaining member.

10. A method for releasably securing a flexible covering over an area defined by a relatively fixed outer supporting frame; said method comprising the following steps:

providing a cord with a retaining member on one end thereof and the other end free;

forming a loop in said cord;

placing the retaining member under the flexible covering;

placing the loop over the retaining member and flexible covering;

then pulling the free end of the cord after the loop is placed over the retaining member for tightening of the loop beneath the retaining member for securing the flexible covering;

providing anchoring means on said supporting frame to secure the free end of said cord and releasably securing the cord to the anchor means.

11. The method as set forth in claim 10 further including the steps of:

providing a cord gripping subassembly for receiving lengths of said cord forming the loop and maintaining the loop in said cord for fitting beneath the retaining member; and pulling the free end of said cord tight from said anchoring means after said cord gripping subassembly is secured to said retaining member and flexible covering.

12. The method as set forth in claim 11 further including the steps of:

providing force applying means on said cord gripping subassembly for gripping said cord under a predetermined maximum gripping force, the tensioning of said cord from said retaining member above a predetermined high amount resulting in a release of said cord by said force applying means thereby to reduce the tension in said cord, the cord gripping subassembly gripping said cord again upon the reaching of a predetermined minimal tensioning of said cord after release thereof.

13. A method for releasably securing a flexible covering over a member within a supporting frame; said method comprising the following steps; providing a cord with a retaining member on one end thereof and the other end free;

providing a cord gripping assembly for forming a loop in said cord with the cord gripping assembly including force applying means receiving a length of said cord forming the loop;

placing the retaining member under the flexible covering;

placing the loop over the retaining member and flexible covering;

pulling the free end of the cord after the loop is placed over the retainer for tightening of the covering and loop on the retaining member with the force applying means applying a predetermined gripping force against said cord;

providing an anchor on said supporting frame to secure the free end of said cord extending from said cord gripping assembly; and releasably securing said cord gripping assembly and cord to said anchor.

14. A method for releasably securing a flexible covering as set forth in claim 13 further including the steps of:

providing releasable cord gripping means on said anchor for securing and gripping said cord extending from said cord gripping assembly under a predetermined maximum gripping force upon pulling of the free end of said cord after tightening said loop about said retainer.

* * * * *